US007150699B2

(12) United States Patent
Yang

(10) Patent No.: US 7,150,699 B2
(45) Date of Patent: Dec. 19, 2006

(54) WATER TRAMPOLINE

(76) Inventor: Yen-Shuo Yang, 2F-3, No. 3, Wu-Chang S. St., Pei Dist., Taichung City (TW)

( * ) Notice: Subject to any disclaimer, the term of this patent is extended or adjusted under 35 U.S.C. 154(b) by 547 days.

(21) Appl. No.: 10/683,726

(22) Filed: Oct. 10, 2003

(65) Prior Publication Data

US 2005/0079955 A1 Apr. 14, 2005

(51) Int. Cl.
*A63B 5/11* (2006.01)

(52) U.S. Cl. ..... 482/27; 482/29; 441/40

(58) Field of Classification Search ..... 482/27–29; 441/40; D21/802, 803, 797
See application file for complete search history.

(56) References Cited

U.S. PATENT DOCUMENTS

| | | | | |
|---|---|---|---|---|
| 2,764,766 | A * | 10/1956 | Boyle et al. | 482/27 |
| 3,047,294 | A * | 7/1962 | Maxwell | 482/27 |
| 4,598,904 | A * | 7/1986 | Roth | 482/27 |
| 4,644,892 | A * | 2/1987 | Fisher | 482/27 |
| 5,299,989 | A * | 4/1994 | Boyd et al. | 482/27 |
| 5,385,518 | A * | 1/1995 | Turner | 482/27 |
| 5,810,695 | A * | 9/1998 | Sass | 482/27 |
| 6,447,426 | B1 * | 9/2002 | Peterson | 482/27 |
| 6,508,682 | B1 * | 1/2003 | Clark | 441/40 |
| 6,582,264 | B1 * | 6/2003 | Brown | 441/40 |
| 6,599,221 | B1 * | 7/2003 | Goldwitz | 482/28 |
| 2004/0134405 | A1 * | 7/2004 | Lekhtman | 114/263 |
| 2005/0148433 | A1 * | 7/2005 | Wang et al. | 482/27 |

FOREIGN PATENT DOCUMENTS

| | | | |
|---|---|---|---|
| EP | 473445 | A1 * | 3/1992 |
| FR | 2698792 | A1 * | 6/1994 |
| WO | WO 9316762 | A1 * | 9/1993 |

* cited by examiner

*Primary Examiner*—Jerome Donnelly
*Assistant Examiner*—Victor K. Hwang
(74) *Attorney, Agent, or Firm*—Pitney Hardin LLP

(57) ABSTRACT

A water trampoline includes a tumbling unit, a plurality of floating members, and a rope assembly. The tumbling unit includes a bed frame, a tumbling mat, and a plurality of elastic members connecting the tumbling mat to the bed frame. The floating members are connected to and are mounted independently around the bed frame. The rope assembly interconnects the floating members. A ladder is attached to one of the floating members. An anchor unit is connected to another one of the floating members and is spaced apart from the ladder at an angular distance.

8 Claims, 10 Drawing Sheets

WATER TRAMPOLINE

BACKGROUND OF THE INVENTION

1. Field of the Invention

The invention relates to an exercise or amusement device, more particularly to a water trampoline that floats on water.

2. Description of the Related Art

Referring to FIG. 1, a conventional water trampoline includes a rebound member 1 and an inflatable tube 2 in the shape of a doughnut and connected to the rebound member 1. Due to the floatability of the inflatable tube 2 on water, the rebound member 1 can permit tumbling exercises by the user.

Although the conventional water trampoline can permit tumbling exercises and provide water amusement at the same time to the user, it has the following disadvantages:

1. Because the rebound member 1 has a considerable area, the inflatable tube 2 that supports the rebound member 1 has to have a considerable size, such that a relatively large equipment must be used to produce the inflatable tube 2, thereby resulting in high costs.

2. Since the inflatable tube 2 is a hollow unitary body, when a puncture or damage occurs on a peripheral wall of the inflatable tube 2, air slowly leaks out of the inflatable tube 2 such that the conventional water trampoline exposes the user to danger.

3. Even if the damage on the inflatable tube 2 can be repaired, the strength properties of the inflatable tube 2 after repair deteriorate.

4. The rebound member 1 has a large volume such that it is difficult to fold and such that assembly, storage, and transport of the same are relatively inconvenient.

5. Because the inflatable tube 2 has a relative height, it is difficult for the user to climb on top of the rebound member 1. Moreover, if the user applies a pressing force on one side of the inflatable tube 2 when climbing, the other side of the inflatable tube 2 may rise and turn over, thereby rendering the conventional water trampoline dangerous to use.

SUMMARY OF THE INVENTION

Therefore, the object of the present invention is to provide a water trampoline that has a plurality of independent floating members, which are replaceable individually, and that is safe to use.

According to this invention, a water trampoline comprises a tumbling unit, a plurality of floating members, and a rope assembly. The tumbling unit includes a bed frame, a tumbling mat, and a plurality of elastic members connecting the tumbling mat to the bed frame. The floating members are connected to and are mounted independently around the bed frame. The rope assembly interconnects the floating members.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
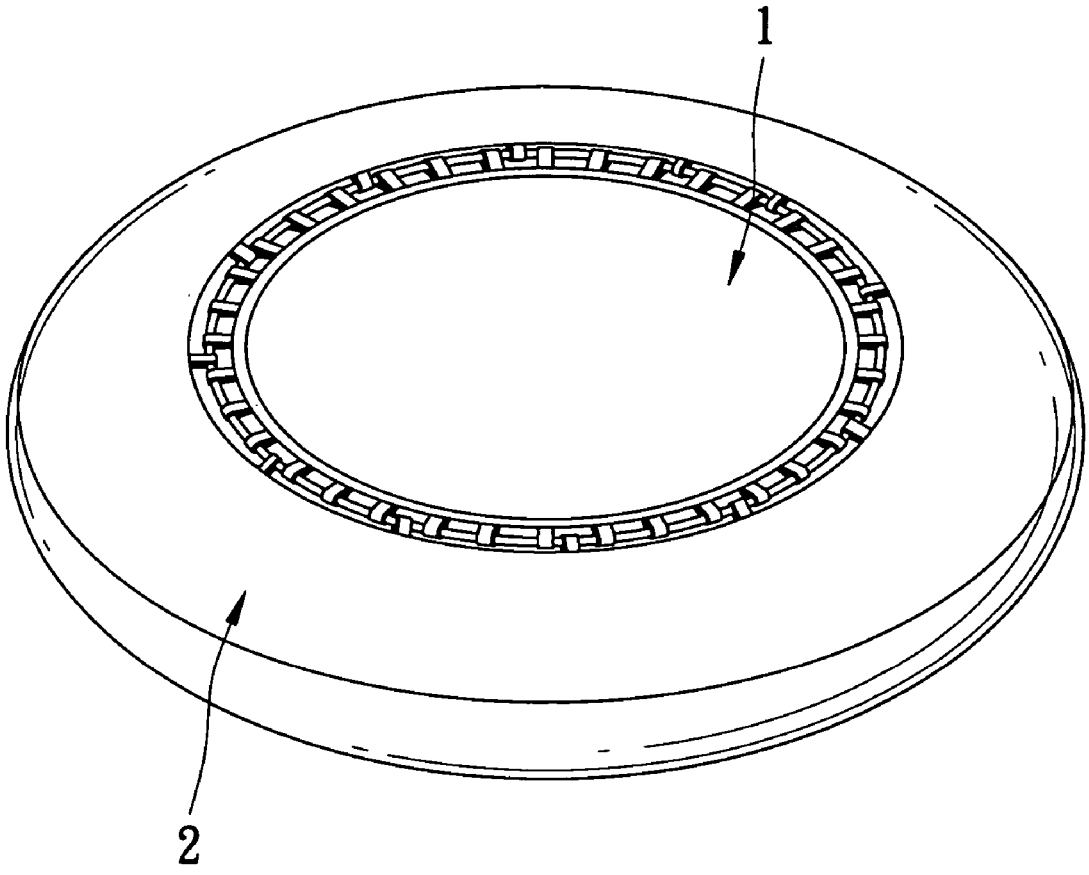
FIG. 1 PRIOR ART
FIG. 1 is a perspective view of a conventional water trampoline.
Figure 2:
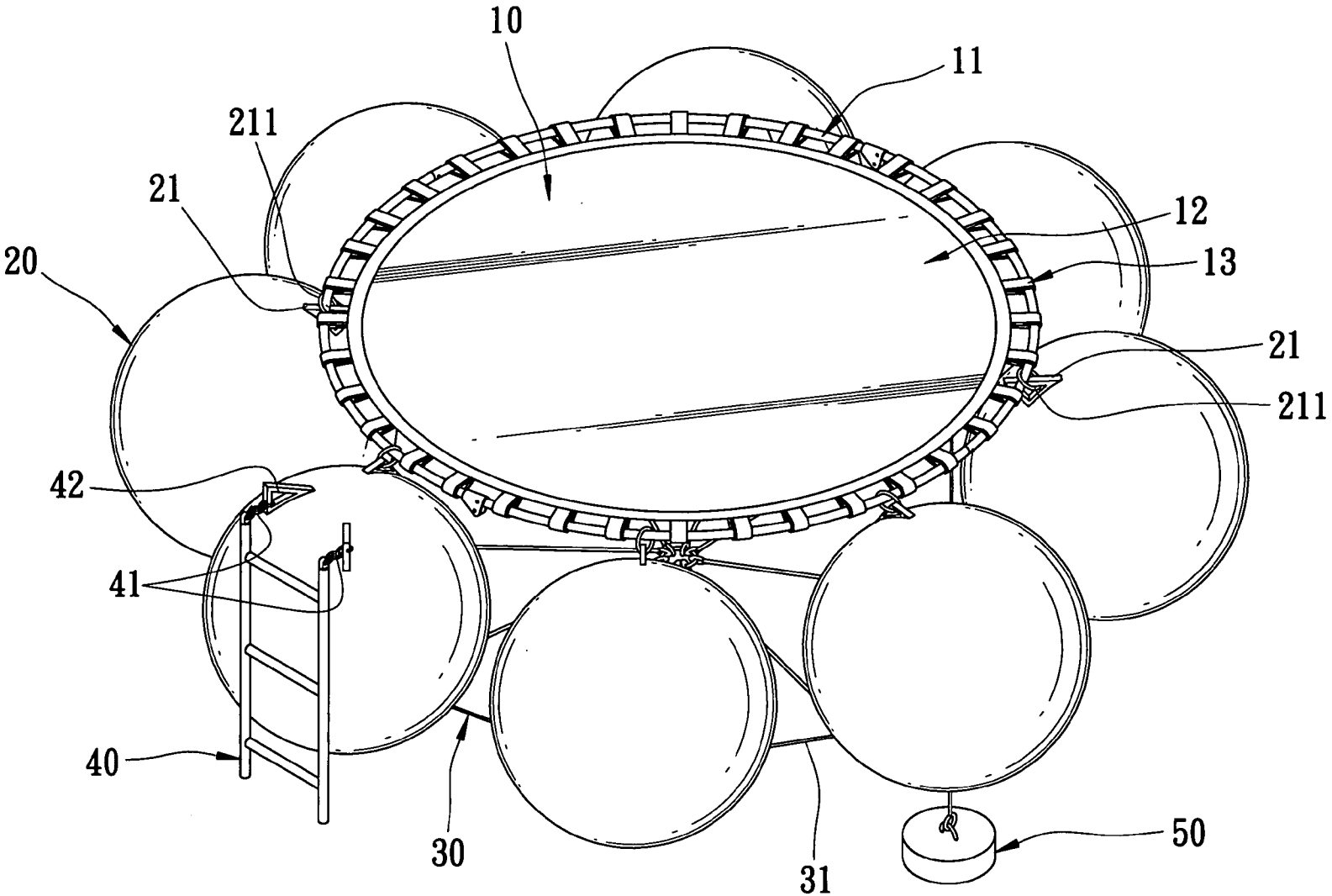
FIG. 2 is a perspective view of the preferred embodiment of a water trampoline according to the present invention.
Figure 3:
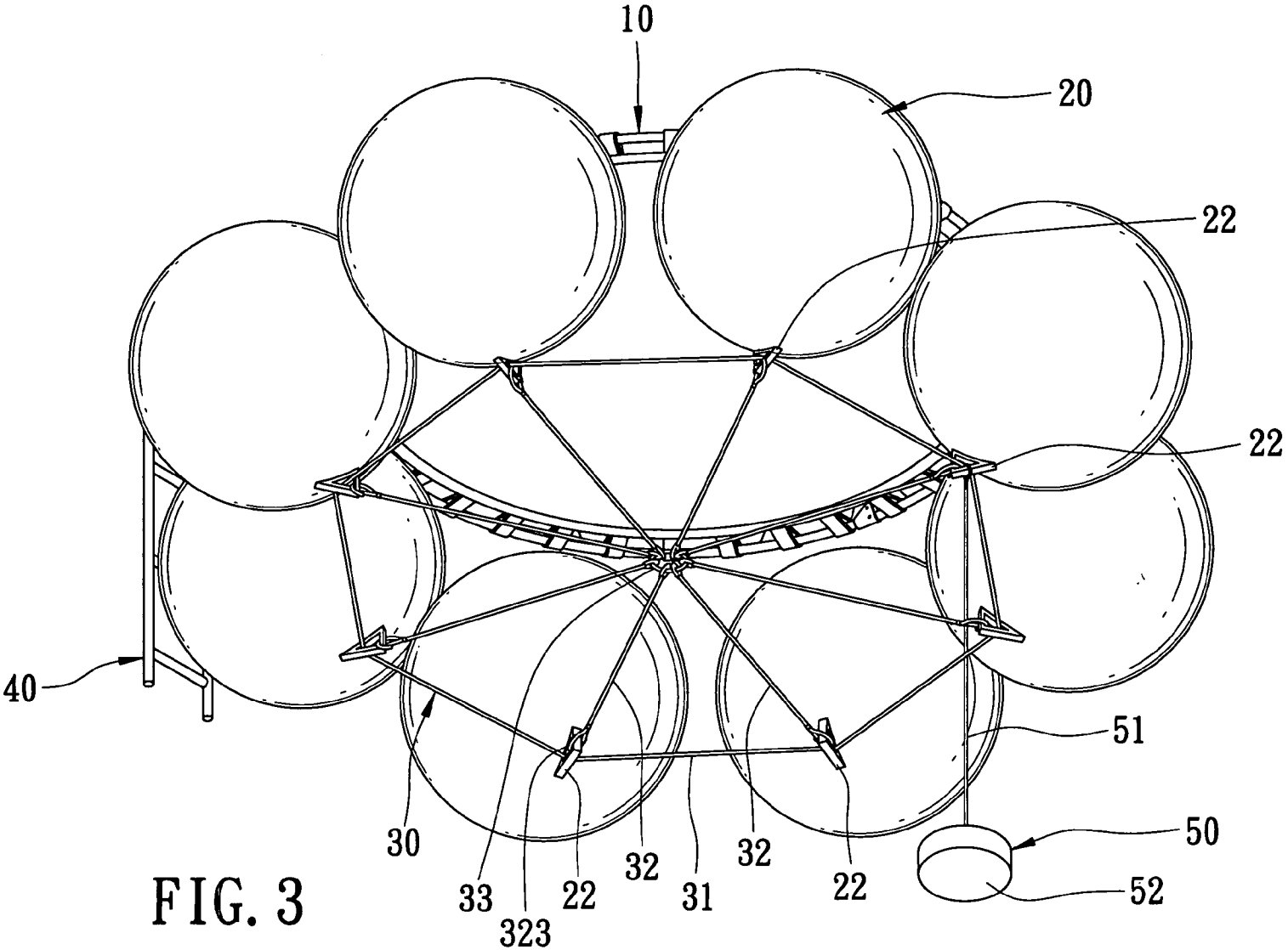
FIG. 3 is a rear perspective view of the preferred embodiment, illustrating how a rope assembly interconnects a plurality of floating members.
Figure 4:
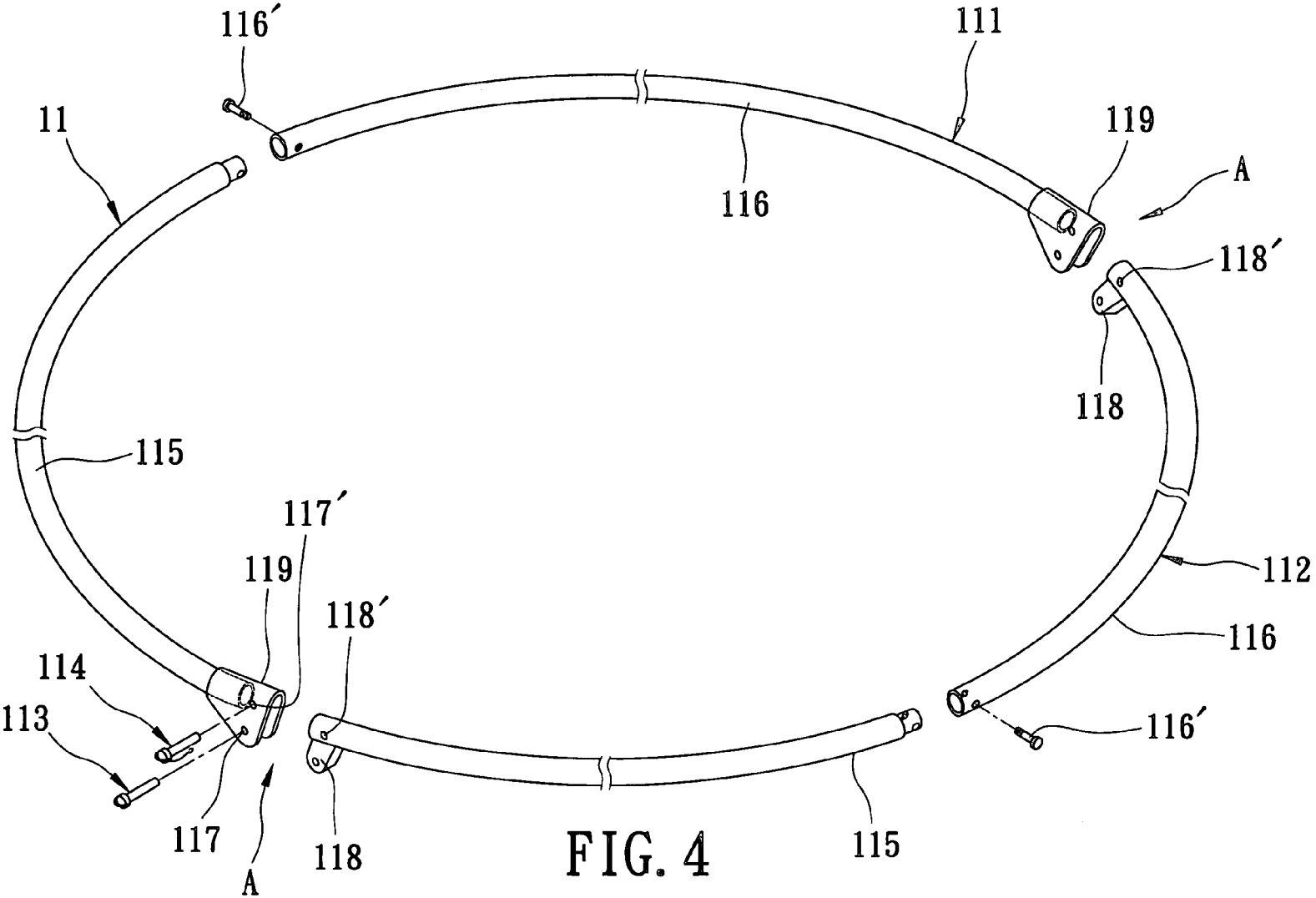
FIG. 4 is an exploded perspective view of a bed frame of the preferred embodiment.
Figure 5:
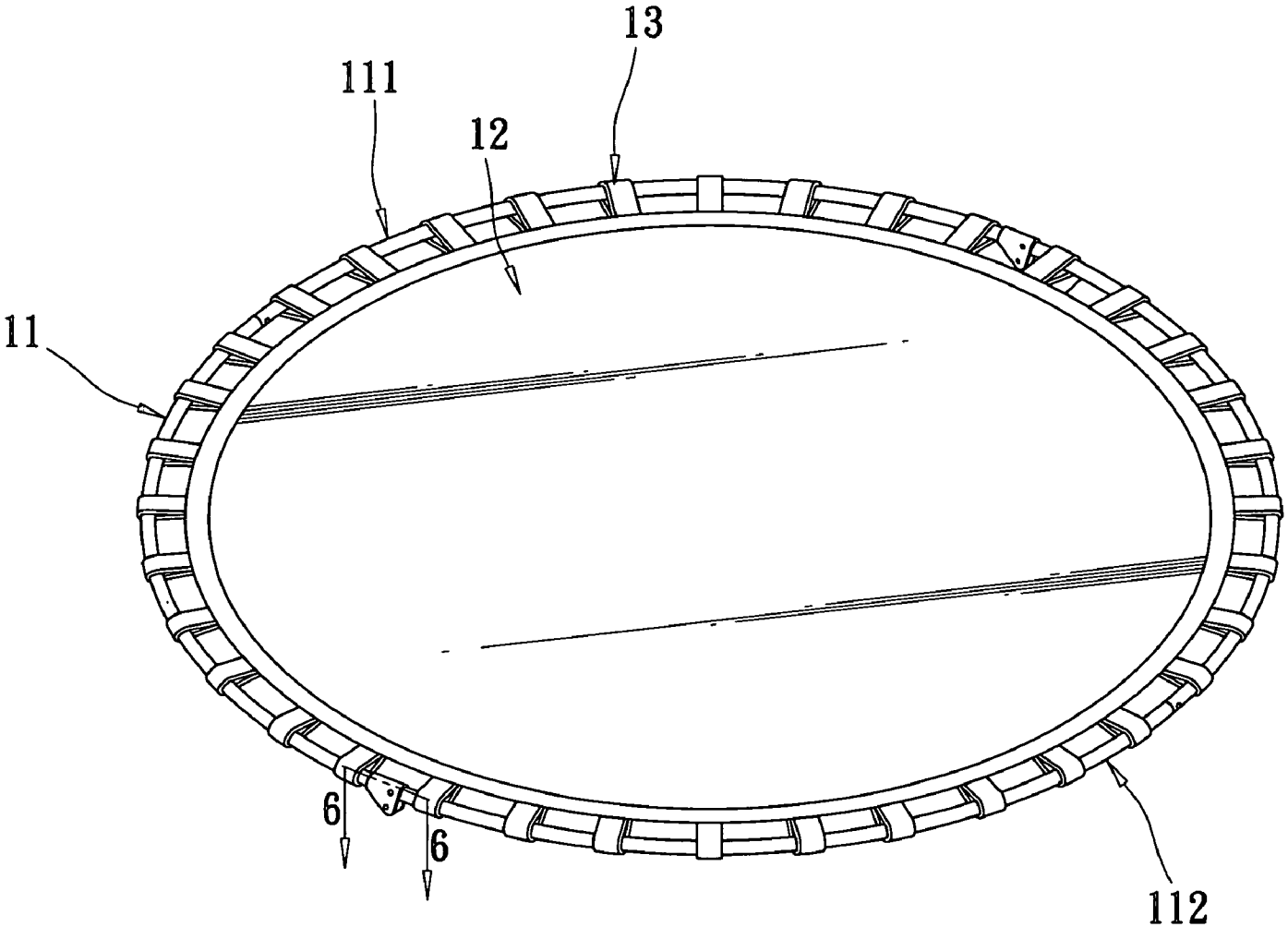
FIG. 5 is a perspective view of a tumbling unit of the preferred embodiment.
Figure 6:
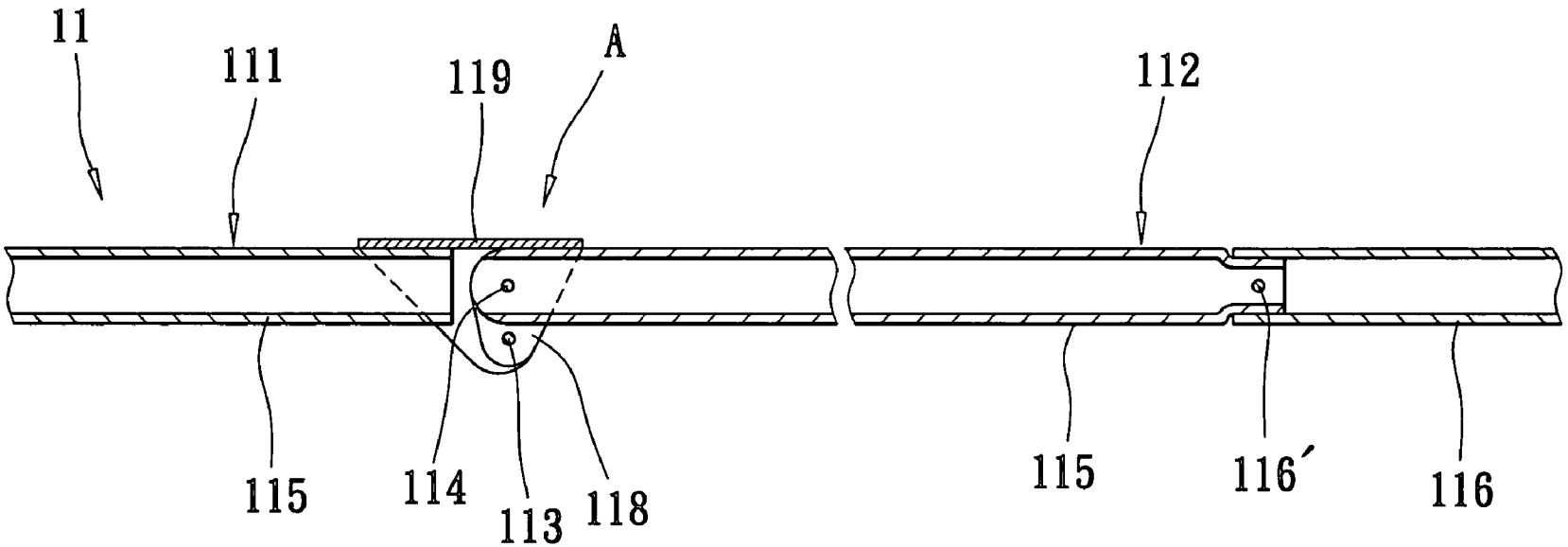
FIG. 6 is a sectional view taken along line 6—6 of FIG. 5.
Figure 7:
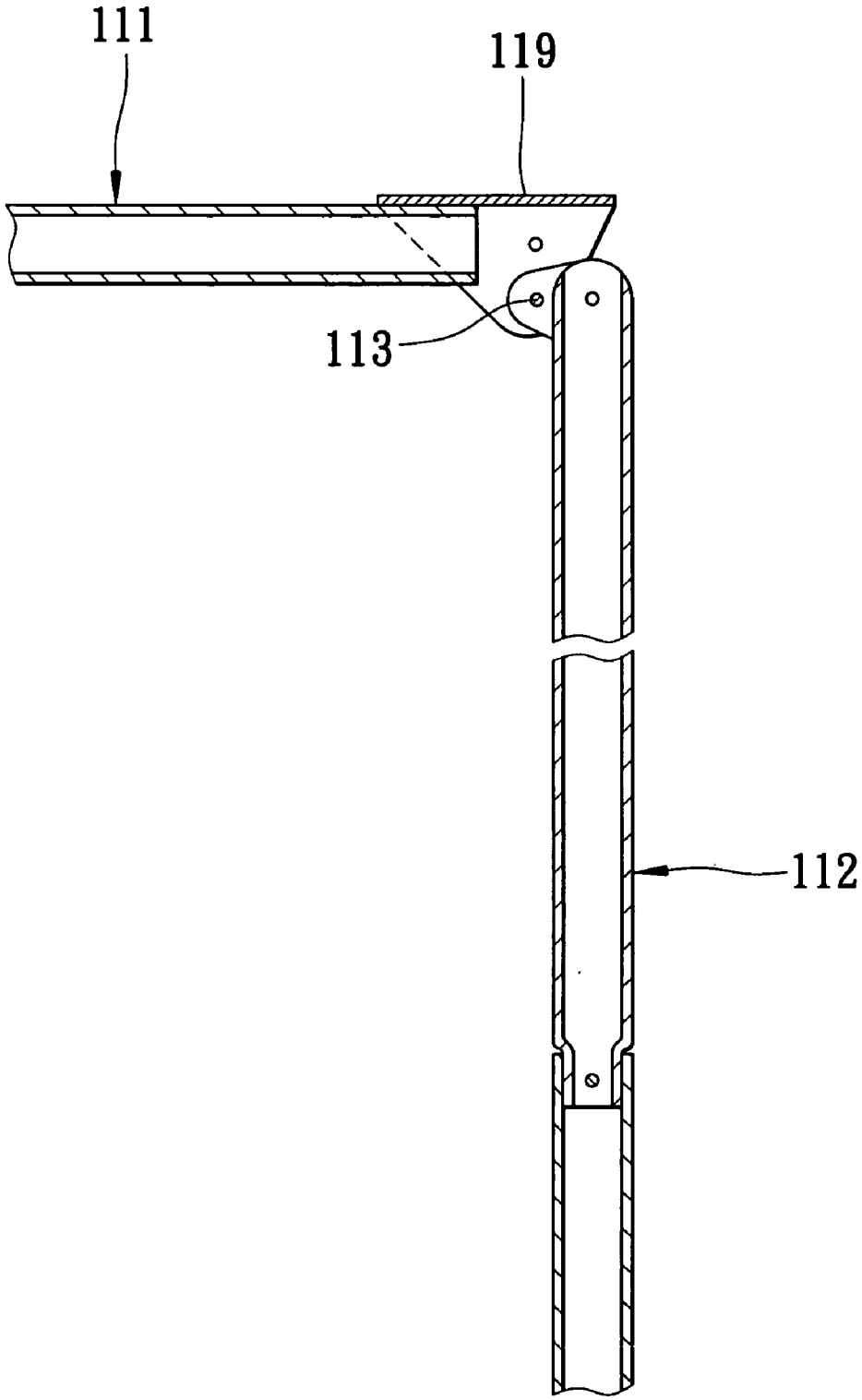
FIG. 7 is a view substantially similar to FIG. 6, illustrating how first and second curved rods of the bed frame are pivotally interconnected.
Figure 8:
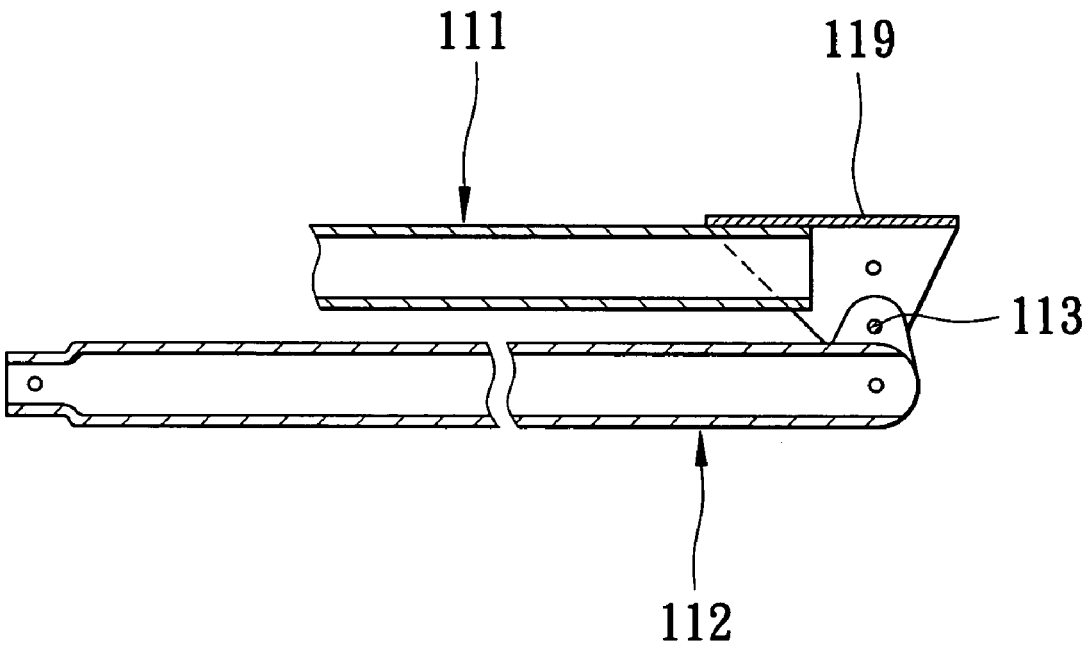
FIG. 8 is a view substantially similar to FIG. 7, illustrating the first and second curved rods of the bed frame in a folded state.

Referring to FIGS. 2 and 3, the preferred embodiment of a water trampoline according to the present invention is shown to comprise a tumbling unit 10, a plurality of inflatable floating members 20, a rope assembly 30, a ladder 40, and an anchor unit 50.

The tumbling unit 10 includes an annular bed frame 11, a tumbling mat 12, and a plurality of elastic members 13 connected between peripheries of the bed frame 11 and the tumbling mat 12.

Referring to FIGS. 4, 5, 6, 7 and 8, the annular bed frame 11 includes first and second curved rods 111, 112 made of metal tubes, and two connectors (A) for pivotally interconnecting the first and second curved rods 111, 112. Each of the first and second curved rods 111, 112 includes two rod sections 115, 116 connected detachably to each other, such as by removably sleeving one into the other and by fastening one to the other through a screw bolt 116'. The connectors (A) include pivot plates 119, each of which has an inverted U-shaped cross-section. Each pivot plate 119 straddles and is fixed to, such as by welding, a respective rod section 115, 116 of the first curved rod 111. Pivot pieces 119' are welded respectively to the rod sections 115, 116 of the second curved rod 112 at the bottom side thereof. Each pivot plate 119 and each pivot piece 119' have pin holes 117 and 118 for passage of a fixed pin 113 so as to connect pivotally the first and second curved rods 111, 112 (see FIGS. 4 and 7). Each pivot plate 119 has a pin hole 117' for insertion of a removable pin 114 which passes through a pin hole 118' formed in one end of the adjacent rod section 115 or 116 of the second curved rod 112 so as to connect the first and second curved rods 111, 112 (see FIGS. 4 and 6). When the removable pin 114 is removed, the first curved rod 111 can be folded over the second curved rod 112 (see FIG. 8).

The tumbling mat 12 (see FIGS. 2 and 5) is made of a high strength woven material, and is rounded so as to complement the shape of the bed frame 11.

The elastic members 13 (see FIGS. 2 and 5) connect the tumbling mat 12 to the bed frame 11 by connecting fixedly two ends of each elastic member 13 to the periphery of the tumbling mat 12 after folding each elastic member 13 about the first or second curved rod 111 or 112 of the bed frame 11. In this embodiment, the elastic members 13 are elastic woven straps that are spaced apart from each other along the peripheries of the first and second curved rods 111, 112 of the bed frame 11.

In this embodiment, each of the inflatable floating members 20 is made of a ball body that is inflatable and deflatable. The floating members 20 are mounted independently around the bed frame 11. Through the inflated floating members 20, the tumbling unit 10 can be raised upwardly so as to be apart from a water surface. Each floating member 20 has an upper ear member 21 connected detachably to the bed frame 11 by means of a ring piece 211, and a lower ear member 22 opposite to the upper ear member 21. Each of the upper and lower ear members 21, 22 is formed as a triangular loop. The rope assembly 30 (see FIG. 3) interconnects the floating members 20, and includes a ring member 33 disposed below the bed frame 11, a one-piece rope member 31, and a plurality of guide ropes 32. The rope member 31 threads through the lower ear members 22 of the floating members 20 so as to surround the ring member 33 and so as to control and limit the bottom portions of the floating members 20 from moving outwardly. The guide ropes 32 are connected to the ring member 33, and extend outwardly and radially therefrom so as to connect respectively with the lower ear members 22 of the floating members 20 by means of a plurality of fastening members 323, which are connected fixedly and respectively to end portions of the guide ropes 32. The fastening members 323 are hooked respectively to the lower ear members 22 so that the bottom portions of the floating members 20 are interconnected and are restrained by each other.

The ladder 40 (see FIG. 2) is attached to one of the floating members 20, and extends from the water surface toward a top portion of the corresponding floating member 20. Two positioning units 42 are mounted fixedly on the top portion of the corresponding floating member 20, and have a structure substantially similar to those of the upper and lower ear members 21, 22. The ladder 40 has two hook members 41, which are attached fixedly to its top end thereof, and which are hooked respectively on the positioning units 42, so that the ladder 40 is suspended from the corresponding floating member 20.

The anchor unit 50 (see FIG. 3) is connected to another one of the floating members 20, and is spaced apart from the ladder 40 at an angular distance of 180°. The anchor unit 50 includes an anchor rope 51 connected to the lower ear member 22 of the corresponding floating member 20, and a counterweight piece 52 attached to a bottom end of the anchor rope 51 and submerged in the water.

When the floating members 20 and the bed frame 11 are interconnected through the ring pieces 211 on the upper ear members 21 of the former, the floating members 20 surround the periphery of the tumbling unit 10. Afterwards, the rope member 31 and the guide ropes 32 are connected to the lower ear members 22 of the floating members 20. The tumbling unit 10 is raised by the floating members 20 to a height higher than the water surface. Subsequently, the ladder 40 is hung on one of the floating members 20 through the hook members 41 and the positioning units 42, and the anchor unit 50 is attached to another one of the floating members 20 opposite to the ladder 40 so as to balance the tumbling unit 10.

In use, after the water trampoline of the present invention floats on the water surface, the user can proceed with tumbling exercises or resting on the tumbling unit 10. The user can use the ladder 40 to get down into the water, or he can jump directly from the tumbling unit 10 into the water, to proceed with swimming and other water games. To return to the tumbling unit 10, the user can easily climb the ladder 40. Even if the user exerts a pressing force on one side of the water trampoline during climbing of the ladder 40, the presence of the anchor unit 50 on the other side of the water trampoline balances the force exerted by the user such that the water trampoline of the present invention is not likely to turn over.

Figure 9:
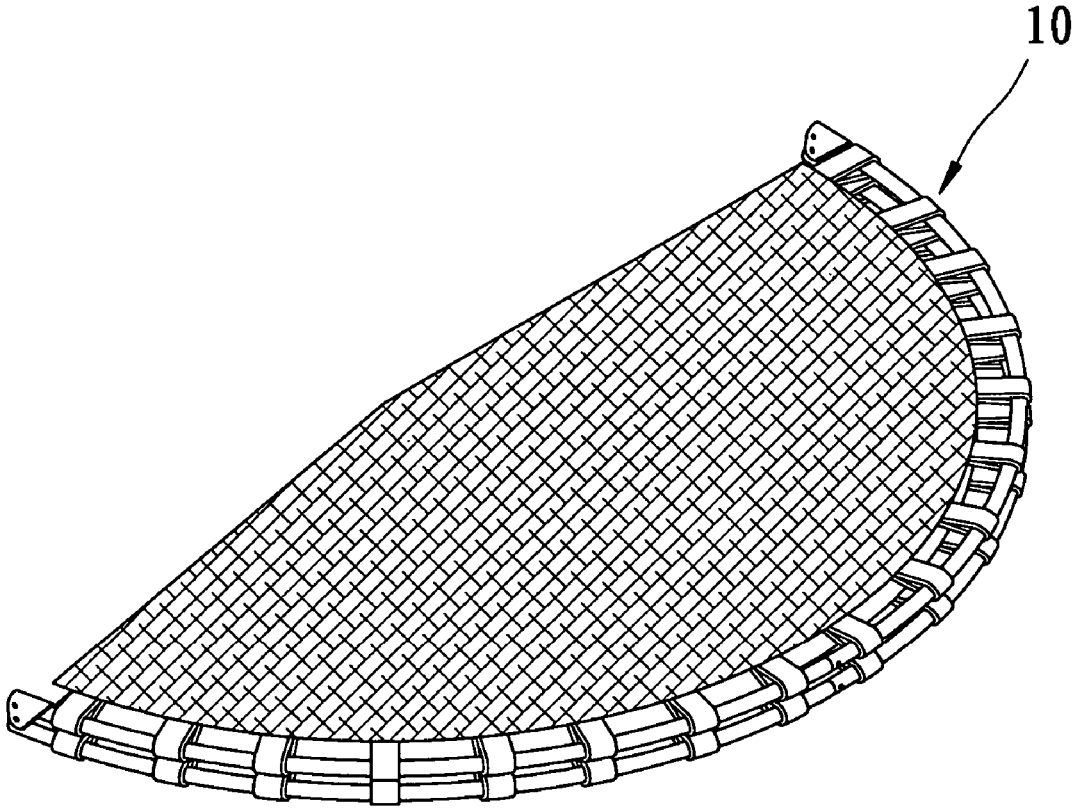
FIG. 9 is a perspective view of the tumbling unit of the preferred embodiment which is folded into a semi-circular shape.

To store the water trampoline of the present invention after use, the user first removes the ladder 40 and the anchor unit 50, and the floating members 20 are then detached one by one from the bed frame 11 and are deflated so as to save storing space. Afterwards, the removable pins 114 are removed from the respective pivot plates 119 so that the second curved rod 112 can rotate relative to the fixed pins 113 until the second curved rod 112 lies under the first curved rod 111 (see FIG. 8). At this time, the tumbling unit 10 is folded into a semi-circular shape (see FIG. 9).

Figure 10:
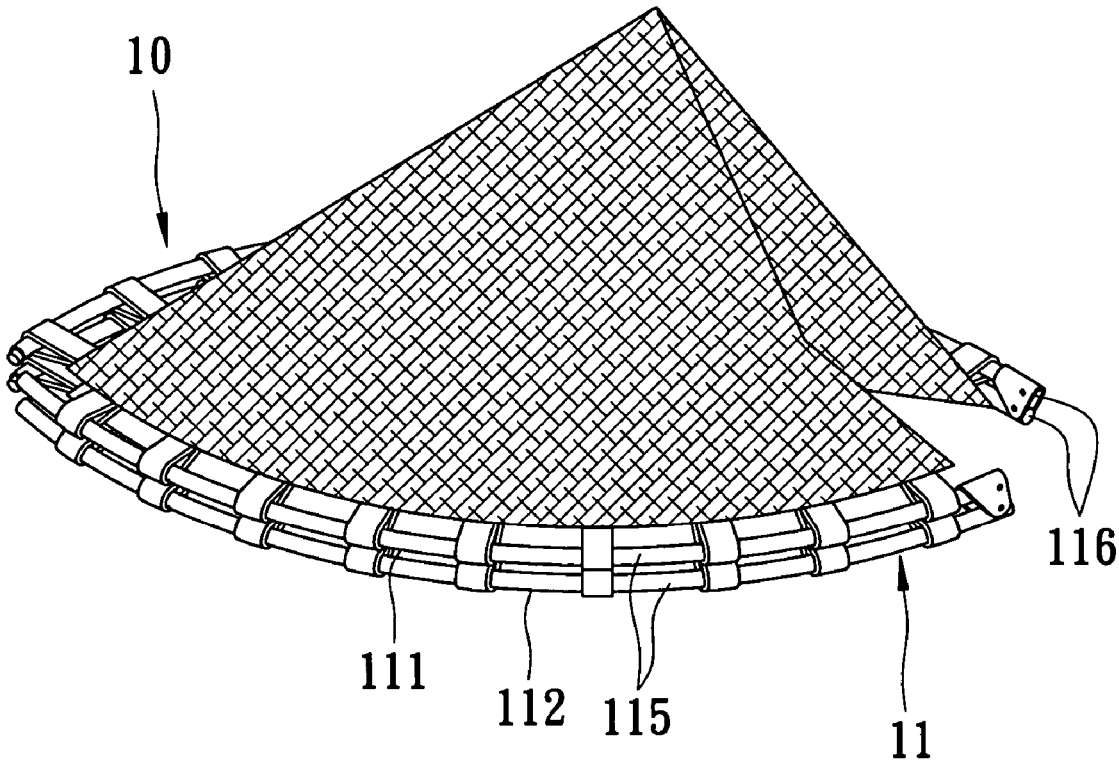
FIG. 10 is a perspective view of the tumbling unit of the preferred embodiment in a completely folded state.

When the screw bolts 116' are loosened, and the rod sections 115, 116 of the first and second curved rods 111, 112 are separated, the tumbling unit 10 can be folded into a much smaller size, as best shown in FIG. 10, thereby facilitating its storage and handling.

When use of the water trampoline of the present invention is desired, the rod sections 115, 116 of the first and second curved rods 111, 112 are interconnected using the screw bolts 116', followed by insertion of the removable pins 114 into the pivot plates 119 so as to connect the first and second curved rods 111, 112 so that the bed frame 11 has a fixed shape to support the tumbling mat 12. Afterwards, the floating members 20 are inflated and connected to the bed frame 11, and the rope assembly 30, the ladder 40, and the anchor unit 50 are mounted and positioned accordingly. The water trampoline is now ready for use.

Therefore, the water trampoline of the present invention has the following advantages:

1. Each of the floating members 20 is independently mounted to and detached from the bed frame 11 so that the size of each floating member 20 is relatively small. As such, each floating member 20 can be produced using smaller equipment so that production can proceed with ease at a relatively low cost.

2. Even if any one or up to half of the floating members 20 are punctured or damaged, the water trampoline of the present invention is unlikely to submerge. Moreover, each floating member 20 can be removed individually to serve as a floater or a life-saving tool.

3. Since the size of each floating member 20 is relatively small, when one of the floating members 20 is damaged, the damaged floating member 20 can be easily replaced by a new one because the user can prepare many spare floating members 20 beforehand so that the present invention is very safe to use.

4. Even if the floating members 20 have a relative height, the user can use the ladder 40 to climb on top of the tumbling unit 10. For users, which are too old or too young, the ladder 40 further has a supporting function.

5. The bed frame 11 can be folded and unfolded as desired so that assembly, storage, handling, and transport of the same are relatively easy. Moreover, the bed frame 11 has a fixed shape after it is unfolded so that it poses no obstacle during tumbling exercises.

6. When the user climbs up the ladder 40, the anchor unit 50 provides counterweight and balancing effects so that the water trampoline of the present invention is safer to use as compared to the aforesaid conventional water trampoline.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

I claim:

1. A water trampoline comprising:

a tumbling unit including a bed frame, a tumbling mat, and a plurality of elastic members connecting said tumbling mat to said bed frame;

a plurality of floating members connected to and mounted independently around said bed frame;

a rope assembly interconnecting said floating members;

a ladder attached to one of said floating members; and an anchor unit that is connected to another one of said floating members and that is spaced apart from said ladder at an angular distance of 180°.

2. The water trampoline as claimed in claim 1, further comprising two positioning units connected to said ladder and mounted on said one of said floating members for suspending said ladder from said one of said floating members.

3. The water trampoline as claimed in claim 1, wherein each of said floating members is ball-shaped.

4. The water trampoline as claimed in claim 1, wherein said bed frame is annular and is composed of first and second curved rods, and a connector for pivotally interconnecting said first and second curved rods so that said first and second curved rods are foldable over each other.

5. The water trampoline as claimed in claim 4, wherein each of said first and second curved rods has a plurality of rod sections that are interconnected detachably.

6. The water trampoline as claimed in claim 4, wherein said connector has a U-shaped pivot plate straddling and fixed to one end of one of said first and second curved rods, a fixed pin, and a removable pin, one end of the other one of said first and second curved rods extending into said pivot plate, said fixed and removable pins extending in parallel through said pivot plate and one end of the other one of said first and second curved rods, said removable pin being removable from said pivot plate and said other one of said first and second curved rods to permit folding of said first and second curved rods over each other.

7. A water trampoline comprising:

a tumbling unit including a bed frame, a tumbling mat, and a plurality of elastic members connecting said tumbling mat to said bed frame;

a plurality of floating members connected to and mounted independently around said bed frame; and a rope assembly interconnecting said floating members.

wherein each of said floating members is connected detachably to said bed frame, and has an upper ear member connected to said bed frame, and a lower ear member opposite to said upper ear member.

8. The water trampoline as claimed in claim 7, wherein said rope assembly includes a ring member below said bed frame, a one-piece rope member threading through said lower ear members of said floating members and surrounding said ring member, and a plurality of guide ropes connected to and extending outwardly from said ring member to connect respectively with said lower ear members of said floating members.

* * * * *